United States Patent [19]

Stupica

[11] 4,238,928

[45] Dec. 16, 1980

[54] HYDRAULIC ENGINE

[76] Inventor: Vekoslav A. Stupica, 2911 N. 73rd Pl., Kansas City, Kans. 66109

[21] Appl. No.: 11,808

[22] Filed: Feb. 14, 1979

[51] Int. Cl.[3] ..... B63H 11/04

[52] U.S. Cl. ..... 60/221; 440/38; 239/265.17; 239/265.29

[58] Field of Search ..... 60/221, 222, 269; 115/12 R, 14, 16; 239/265.17, 265.29, 432

[56] References Cited

U.S. PATENT DOCUMENTS

| | | | |
|---|---|---|---|
| 1,422,384 | 7/1922 | South | 60/269 X |
| 2,699,644 | 1/1955 | Coanda | 60/221 X |
| 3,021,669 | 2/1962 | Nye | 60/269 |
| 3,447,324 | 6/1969 | French | 60/221 |
| 3,809,005 | 5/1974 | Rodler | 115/12 R |
| 3,973,731 | 8/1976 | Thayer | 239/265.29 X |

*Primary Examiner*—Robert E. Garrett
*Assistant Examiner*—Edward Look

[57] ABSTRACT

An improved hydraulic engine for boats and the like is provided which preferably includes a rearwardly facing concave impingement surface, along with nozzle apparatus for directing a stream of pressurized water against the impingement surface in order to move the boat forwardly through the water. An oppositely oriented, concave, flow-directional surface is disposed in partial opposition to the impingement surface for deflecting non-pressurized water against the impingement surface as the boat moves through the water. The below water portion of the engine is housed in an open-ended casing, and can be rectangular or circular configuration.

12 Claims, 6 Drawing Figures

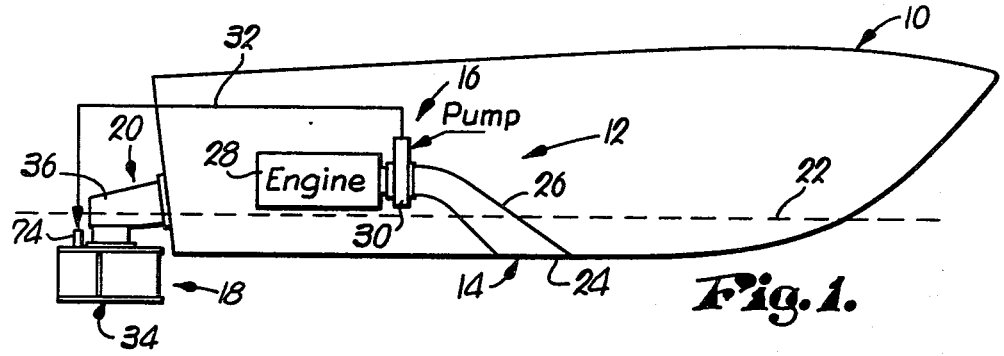
Fig. 1.
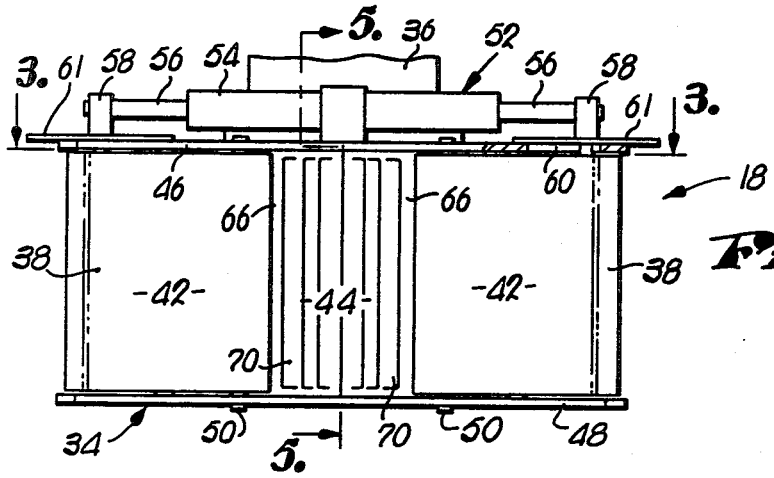
Fig. 2.
Fig. 3.
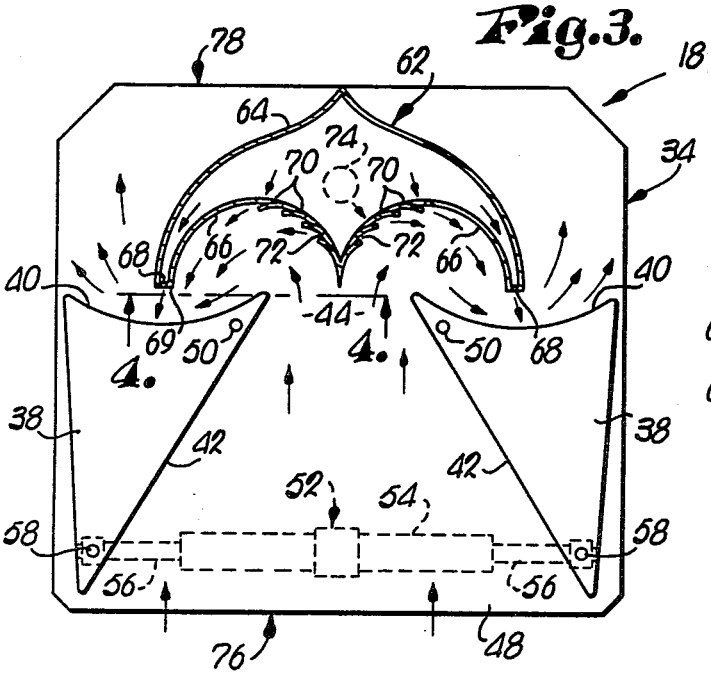
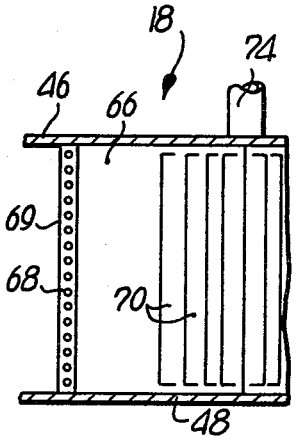
Fig. 4.

HYDRAULIC ENGINE

BACKGROUND OF THE INVENTION

1. Field of the Invention

The present invention is concerned with a hydraulic engine for use with water borne conveyances such as boats and the like. More particularly, it is concerned with an improved hydraulic engine having a rearwardly facing, below water impingement surface, along with nozzle structure for directing a stream of pressurized water against the impingement surface in order to move the boat forwardly through the water.

2. Background of the Prior Art

A number of hydraulic engines have been proposed in the past for use in propelling boats or the like through the water. Representative engines are disclosed in U.S. Pat. Nos. 1,677,769, 3,007,305, 3,183,663, 3,288,100, 3,478,712 and 3,561,392.

All of the above patents describe engines wherein pressurized streams of water are directed rearwardly in order to obtain foreward movement of a water craft. Furthermore, as any person familiar with boat propulsion systems will attest, hydraulic engines heretofore available have achieved very little commercial and practical success.

SUMMARY OF THE INVENTION

The present invention represents a departure from past hydraulic engine designs inasmuch as the engine hereof is provided with a rearwardly facing, preferable concave impingement surface along with nozzle structure for directing pressurized water against the impingement surface for propulsion purposes. Thus, the pressurized water is first directed generally parallel to the path of foreward movement of the boat, whereupon the water of the stream is then deflected rearwardly in a direction opposite to the boat's path of travel.

In further preferred constructions, the engine is provided with a forewardly facing concave water flow-directing surface which is adjacent and in partial opposition to the impingement surface of the engine so that additional water is directed against the impingement surface, along with the pressurized streams.

The below water components of the engine are normally housed within an open ended casing permitting water flow therethrough as the boat moves through the water. The engine may be of either generally rectangular or annular configuration.

BRIEF DESCRIPTION OF THE DRAWINGS

FIG. 1 is a schematic elevational view illustrating a boat having the hydraulic engine of the invention mounted thereon;

FIG. 2 is an enlarged front elevational view of the engine, depicting the water intake end thereof;

FIG. 3 is a sectional view taken along line 3—3 of FIG. 2 which illustrates the internal construction of the engine, with arrows being provided to illustrate water flow therethrough;

FIG. 4 is a sectional view taken along line 4—4 of FIG. 3 which further illustrates the construction of the engine;

DESCRIPTION OF THE PREFERRED EMBODIMENTS

Figure 5:
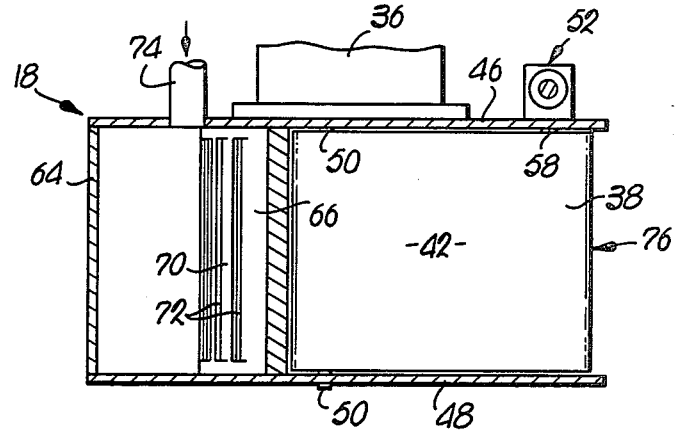
FIG. 5 is a vertical sectional view taken along irregular line 5—5 of FIG. 2.

Referring now to the drawings, a boat 10 is illustrated in FIG. 1 which includes a hydraulic engine 12 in accordance with the invention. The engine 12 broadly includes water takeup means 14, a pumping assembly 16, a drive assembly 18, and means 20 for mounting the assembly 18 below the water line 22 of the boat 10.

Water takeup means 14 includes an aperture 24 through the hull of boat 10 below water line 22, as well as a water-conveying pipe 26 extending from the aperture 24. Pumping assembly 16 includes an engine or motor 28 drivingly coupled to a conventional water pump 30. The motor 28 can be electrical, air-driven, gasoline or hydraulic; and can of course be mounted within boat 10 or exteriorly thereof with the assembly 18. Pipe 26 is secured to the inlet side of pump 30, while a water line 32 extends from the outlet side of the pump 30 to drive assembly 18 as will be explained.

In other embodiments, an air pump can be substituted for water pump 30 and the associated structure; in such cases pressurized air is directed to the assembly 18 and serves to create a pressurized stream of water as the air exits the apparatus 62 to be described hereinafter.

Mounting means 20 includes a casing broadly referred to by the numeral 34 for the internal components of assembly 18, as well as conventional securing structure 36 respectively coupled to the stern of boat 10 and casing 34.

Turning now to FIGS. 2–5, drive assembly 18 includes a pair of elongated, laterally spaced, upright elements 38 which are somewhat triangular in plan and present a pair of upright, rearwardly facing (relative to boat 10) concave impingement surfaces 40. As best seen in FIG. 3, each element 38 includes a planar water entry face 42 which extends inwardly such that the respective faces 42 cooperatively define a restricted water inlet throat 44.

The elements 38 are supported by the casing 34 which in this instance includes an upper plate 46 and a lower plate 48. A pair of upright pivot pins 50 extend between the plates 46, 48, and each element 38 is mounted for pivotal shifting movement about a corresponding pin 50. Selectively actuatable shifting means 52 for the element 38 is provided and includes a hydraulic cylinder 54 having a pair of piston rods 56 respectively extending from each end thereof. The rods 56 are connected to corresponding vertical shifting pins 58, and the latter are secured to an underlying element 38. The pins 58 pass through respective guide slots 60 provided in upper plate 46, and each pin carries a shiftable sealing plate 61.

Apparatus 62 for directing pressurized streams of water against the respective impingement surfaces 40 is also supported between the plates 46, 48, and includes an elongate, upright housing 64. The housing 64 is disposed centrally between the elements 38, is defined by the plates 46, 48 and upright sidewalls, and presents a pair of side-by-side, elongated, upright, water flow-directing surfaces 66 which are each concave in horizontal cross section (see FIG. 3). It will also be noted that the concavities presented by the surfaces 66 are oppositely oriented horizontally relative to the concavities defined by the impingement surfaces 40; moreover, each flow-directing surface 66 is in partial opposed relationship to a corresponding adjacent impingement surface 40.

A plurality of spaced, vertically aligned nozzle-defining apertures 68 are located through narrow defining walls 69 of housing 64 proximal to a corresponding impingement surface 40. As best seen in FIGS. 3 and 4, the apertures 68 extend for the full height of housing 64 and are located adjacent the outermost end of each surface 66.

A plurality of elongated, upright, stationary vane-like members 70 are formed in each surface 66 and cooperatively define a plurality of elongated, upright, side-by-side water flow-directing openings 72 therebetween. A water supply pipe 74 extends through top wall 48 and communicates with the interior of housing 64. As illustrated in FIG. 1, pipe 74 is coupled to line 32 leading from the outlet side of pump 30.

When mounted on a water borne conveyance as illustrated in FIG. 1, the drive assembly 18 is located below the water line, and preferably below the keel of the boat. In such orientation the open, forward, water entry end 76, and the open, rearward water exit end 78, of the casing 34 permits water to flow through the assembly 18 (in addition to pressurized streams of water as will be described) as the boat advances through the water.

During operation of engine 12, pumping assembly 16 operates to take up water through intake aperture 24, whereupon this water is pressurized in pump 30 and sent under pressure through line 32 and pipe 74 into housing 64. At this point the pressurized water is directed through the respective nozzle apertures 68 and against the impingement surfaces 40 of the elements 38. At the same time, streams of water are directed through the openings 72 along an arcuate path which likewise guides the streams of water to the respective surfaces 40. When the pressurized streams of water impinge against the surfaces 40 they are deflected rearwardly for exit out the rearward end 78 of the casing 34.

At the same time however, water entering forward end 76 of casing 34 passes through restricted throat 40 and is directed, by means of the arcuate surfaces 66, against the impingement surfaces 40. Thus, as the boat advances through the water, initially pressurized streams of water impinge against the surfaces 40, as well as water passing through the assembly 18. The net effect of this action is to propel the boat forwardly along its path of travel; and it will be noted in this respect that the streams of pressurized water are initially directed generally parallel to the forward path of travel of the boat, whereupon the water of the pressurized stream is thence directed by impingement against the surfaces 40 in a direction generally opposite to the desired forward path of travel for propulsion purposes. The direction of travel of the pressurized streams of water, as well as the additional non-pressurized water flowing through the assembly 18, is illustrated by means of arrows in FIG. 3.

Changes in direction of travel can be effected by means of boat-mounted auxiliary rudders (not shown) or by rotation of the drive assembly 18 and casing 34 about its vertical mounting axis, through use of conventional mechanism for this purpose.

Figure 6:
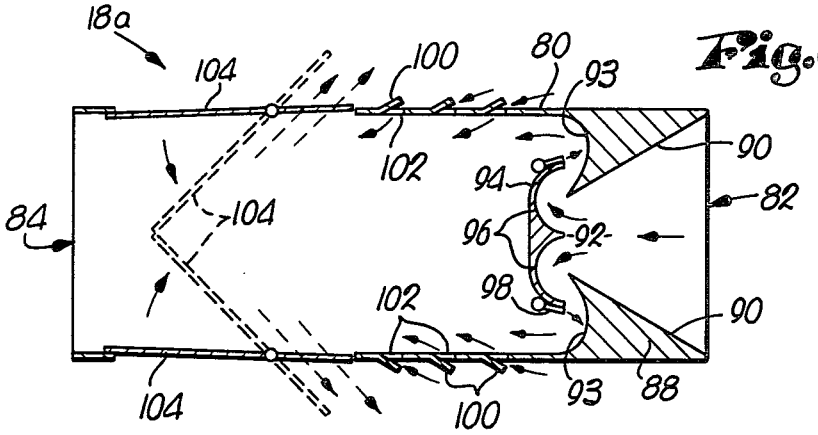
FIG. 6 is a plan view of a second embodiment of the invention wherein apertured, elongated, rearwardly extending sidewalls are provided, along with a selectively openable gate.

Attention is now directed to FIG. 6 which illustrates another embodiment 18*a* of a drive assembly in accordance with the invention. In this instance an elongated, circumscribing casing 80 of rectangular configuration is provided which defines an open, forward, water entry end 82, and a normally open, rearward water exit end 84. A pair of upright, elongated structures 88 are integral with the forward end of casing 80 and include respective, generally planar sidewalls 90 which converge toward each other and cooperatively define a restricted water inlet throat 92. The structures also present respective, laterally spaced, concave impingement surfaces 93 which face toward rearward end 82.

An elongated, upright, flow-directional element 94 is located between the structures 88 and is configured to present a pair of elongated, upright, side-by-side, concave flow-directional surfaces 96. As was the case in the first described embodiment, the concavities presented by the surfaces 96 are oppositely oriented horizontally relative to the concavities defined by the surfaces 93, and the opposed concavities are in partial opposition to one another.

A plurality of spaced, vertically aligned nozzles 98 are disposed along each side edge of the element 94 adjacent to the corresponding surface 96. As illustrated, the nozzles 98 are oriented such that streams of pressurized water emanating therefrom are directed against the surfaces 93.

Casing 80 is longer than the casing 34 described in the embodiment of FIGS. 1–5. The casing is further provided with a plurality of longitudinally spaced, side-by-side, outwardly inclined, stationary vane-like elements 100 which have corresponding openings 102 adjacent thereto. These openings 102 allow entry of water into casing 80 during travel of a boat or the like through the water. In addition, a pair of pivotally mounted gate members 104 are provided on casing 80 and are configured to be selectively closed as illustrated in phantom in FIG. 6. The purpose of this is to close off the normally open rearward end 84 of casing 80, so as to provide a reversing function for the overall hydraulic engine.

In operation, the embodiment of FIG. 6 is mounted below the water line of a boat, and a source of pressurized water is operatively coupled to the respective nozzles 98 by conventional means (not shown). Use of the FIG. 6 embodiment is substantially identical with that described with respect to the embodiment of FIGS. 15, in that pressurized streams of water are directed through the nozzles 98 against the impingement surfaces 93, whereupon these streams are deflected rearwardly for propulsion purposes. At the same time additional volumes of water enter casing 80 through end 82 and are diverted by means of the surfaces 96 against the opposed surfaces 93. At the same time however, additional water enters casing 80 through the openings 102. All the water exiting the casing through normally open rearward end 84 serves to propel the boat forwardly through the water. In the event that it is desired to move the boat astern, it is only necessary to close the gates 104, whereupon the above described operation will be reversed for rearward movement of the boat.

Having thus described the invention, what is claimed as new and desired to be secured by Letters Patent is:

1. A hydraulic engine for propelling a water-borne conveyance along a path of travel through the water, said engine comprising:

structure presenting an impingement surface;

means for creating a pressurized stream of water;

means for directing said pressurized stream against said impingement surface, said impingement surface and stream-directing means being cooperatively oriented such that said stream of pressurized water is directed generally parallel to said path of travel, and the water of said stream is thence directed by said impingement surface in a direction generally opposite to said path of travel;

means for mounting said surface-presenting structure and said stream-directing means on said conveyance below the water line thereof and in a disposition for propelling said conveyance along said path, when said stream-creating and directing means operate; and flow-directing means for directing a flow of water, in addition to said pressurized stream of water, against said impingement surface as said conveyance moves along said path of travel.

2. The engine as set forth in claim 1 wherein said impingement surface is concave in horizontal cross-section.

3. The engine as set forth in claim 2 including a pair of separate, spaced impingement surfaces, and means for directing respective streams of pressurized water against each surface.

4. The engine as set forth in claim 3 including means for shifting said impingement surfaces.

5. The engine as set forth in claim 3 wherein said structure includes a pair of spaced, impingement surface-presenting elements, means mounting each element for pivotal shifting thereof, and means for pivotal shifting of said elements.

6. The engine as set forth in claim 1 wherein said stream-creating means includes water pickup means, pump means, and means for conveying a stream of pressurized water to said stream-directing means.

7. The engine as set forth in claim 1 wherein said stream-directing means includes nozzle structure located adjacent said impingement surface.

8. The engine as set forth in claim 7 wherein said stream-directing means also includes a housing for receiving said stream of pressurized water, said housing being configured to present said nozzle structure.

9. The engine as set forth in claim 8 wherein said housing structure defines a plurality of water flow-directing openings adjacent said nozzle structure.

10. The engine as set forth in claim 1 wherein said mounting means includes an open-ended casing for said impingement surface and stream-directing means, and means securing said casing on said conveyance below the water line of the latter.

11. The engine as set forth in claim 1 wherein:

said structure includes a pair of elongated, laterally spaced, upright elements each presenting an impingement surface which is concave in horizontal cross-section;

said stream-directing means includes a respective nozzle structure adjacent each of said impingement surfaces;

said flow-directing means includes a pair of side-by-side, elongated, upright, water flow directing surfaces of concave horizontal cross section location between said nozzle structures, the concavities presented by said impingement surfaces being oppositely oriented horizontally relative to the concavities presented by said water flow-directing surfaces, with each flow-directing surface being in at least partial opposed relationship to a corresponding adjacent impingement surface; and said mounting means includes an elongated, open-ended casing for said elements, said nozzle structures, and said flow-directing means, and means securing said casing to said conveyance below the water line of the latter, the forward end of said casing allowing flow of water into said casing whereupon said flow of water is directed by said flow-directing surfaces against said impingement surfaces in addition to the pressurized streams of water from said nozzle structures, the rearward open end of said casing allowing flow of water from said impingement surfaces out of said casing.

12. The engine as set forth in claim 1 wherein:

said impingement surface is of annular configuration and is concave in cross-section;

said stream-directing means includes a plurality of annularly arranged nozzle structures adjacent and opposed to said impingement surface, said flow-directing means includes an annular water flow-directing surface, the concavity presented by said impingement surface being oppositely oriented relative to the concavity presented by said water flow-directing surface, with said flow-directing surface being in at least partial opposed relationship to said impingement surface; and said mounting means includes an elongated open-ended casing for said impingement surface, said nozzle structure, and said flow-directing means, and means securing said casing to said conveyance below the water line of the latter with the axis of revolution of said impingement surface and water flow-directing surface being oriented generally horizontally, the forward open end of said casing allowing flow of water into said casing whereupon said flow of water is directed by said flow-directing surface against said impingement surface in addition to the pressurized streams of water from said nozzle structures, the rearward open end of said casing allowing flow of water from said impingement surface out of said casing.

* * * * *